US008227167B2

(12) United States Patent
Itou et al.

(10) Patent No.: US 8,227,167 B2
(45) Date of Patent: Jul. 24, 2012

(54) DEVELOPING AGENT AND METHOD FOR PRODUCING DEVELOPING AGENT

(75) Inventors: Tsuyoshi Itou, Izunokuni (JP); Takayasu Aoki, Mishima (JP); Takashi Urabe, Sunto-gun (JP); Yasuhito Noda, Mishima (JP); Motonari Udo, Mishima (JP); Satoshi Araki, Izunokuni (JP); Masahiro Ikuta, Mishima (JP); Takafumi Hara, Mishima (JP); Asumi Matsumoto, Sunto-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 553 days.

(21) Appl. No.: 12/500,085

(22) Filed: Jul. 9, 2009

(65) Prior Publication Data

US 2010/0009281 A1 Jan. 14, 2010

Related U.S. Application Data

(60) Provisional application No. 61/080,559, filed on Jul. 14, 2008, provisional application No. 61/080,560, filed on Jul. 14, 2008.

(51) Int. Cl.
*G03G 9/08* (2006.01)

(52) U.S. Cl. ..... 430/137.1; 430/137.14; 430/137.18; 430/137.19

(58) Field of Classification Search ..... 430/137.1, 430/137.14, 138.18, 137.19
See application file for complete search history.

(56) References Cited

U.S. PATENT DOCUMENTS

| | | | | |
|---|---|---|---|---|
| 7,704,664 | B2 * | 4/2010 | Matsumoto et al. | 430/137.14 |
| 8,067,143 | B2 * | 11/2011 | Kikawa et al. | 430/137.12 |
| 2005/0202336 | A1 * | 9/2005 | Kawase et al. | 430/137.1 |
| 2007/0281240 | A1 | 12/2007 | Urabe et al. | |
| 2008/0131808 | A1 | 6/2008 | Urabe et al. | |

FOREIGN PATENT DOCUMENTS

| | | |
|---|---|---|
| JP | 60-225170 | 11/1985 |
| JP | 63-282749 | 11/1988 |
| JP | 06-282099 | 10/1994 |
| JP | 09-311502 | 12/1997 |
| JP | 2007-323071 | 12/2007 |

* cited by examiner

*Primary Examiner* — Hoa V Le
(74) *Attorney, Agent, or Firm* — Turocy & Watson, LLP

(57) ABSTRACT

The method for producing a developing agent according to the invention contains subjecting the toner material dispersion liquid to mechanical shearing to make the granular mixture into fine particles, thereby providing a dispersion liquid containing fine particles having a smaller particle diameter than a particle diameter of the granular mixture. The toner material dispersion liquid is subjected to mechanical shearing under a temperature of a glass transition point Tg of the binder resin or more and a pressure of 10 MPa or more, and the resulting dispersion liquid containing the fine particles is depressurized with two or more stages while maintaining the temperature of a glass transition point Tg of the binder resin or more and then cooled to a temperature of a glass transition point Tg of the binder resin or less.

7 Claims, 5 Drawing Sheets

DEVELOPING AGENT AND METHOD FOR PRODUCING DEVELOPING AGENT

CROSS-REFERENCE TO RELATED APPLICATION

This application is based upon and claims the benefit of priority from U.S. Provisional Applications No. 61/080,559, filed Jul. 14, 2008; and No. 61/080,560, filed Jul. 14, 2008, the entire contents of both of which are incorporated herein by reference.

TECHNICAL FIELD

The present invention relates to a method for producing a developing agent for developing an electrostatic image and a magnetic latent image in an electrophotographic process, an electrostatic printing process, a magnetic recording process and the like.

BACKGROUND

In an electrophotographic process, an electric latent image is formed on an image holding member, and the latent image is developed with a toner to form a toner image, which is transferred to a transfer material, such as paper, and then fixed by such measures as heat and pressure. The toner used herein includes not only a conventional monochrome black toner, but also toners of plural colors for forming a full color image.

The toner is used as a two-component developing agent after mixing with carrier particles or as a one-component developing agent, which may be a magnetic toner or a non-magnetic toner. The toner is generally produced by a kneading and pulverization method. In the kneading and pulverization method, raw materials, such as a binder resin, a pigment, a releasing agent, such as wax and a charge controlling agent, are melt-kneaded to form a mixture, and the mixture is cooled, then finely pulverized and classified to produce target toner particles. To the surface of the toner particles produced by the kneading and pulverization method, inorganic fine particles and/or organic fine particles are added to provide a toner.

The toner particles produced by the kneading and pulverization method have an irregular shape and heterogeneous surface composition. The shape and the surface composition of the toner particles are slightly changed by the pulverizing property of the materials used and the conditions upon pulverizing, but are difficult to control purposefully.

The use of a material that has higher pulverizing property provides the following problems. The toner particles are further pulverized to fine particles due to various kinds of stress in a developing device to change the shape thereof. As a result, in a two-component developing agent using the toner particles, the finely pulverized toner particles are firmly adhered to the surface of the carrier to accelerate deterioration in charging property of the developing agent. In a one-component developing agent using the toner particles, the particle size distribution is broadened, whereby the finely pulverized toner particles are scattered, and the developing property is deteriorated due to change in shape of the toner, which bring about deterioration in image quality.

A toner containing a releasing agent, such as wax, may suffer pulverization at the boundary between the binder resin and the releasing agent, which may cause exposure of the releasing agent on the surface of the toner. In particular, a toner containing a resin that has high elasticity and is hard to be pulverized and brittle wax, such as polyethylene wax, frequently suffers exposure of the polyethylene wax on the surface of the toner. The toner is advantageous in releasing property upon fixing and in cleaning property of the non-transferred toner from a photoreceptor, but the polyethylene wax on the surface of the toner may be released from the toner by a mechanical force, such as a shearing force, in a developing device and may be easily transferred to a developing roller, an image holding member, a carrier and the like. Accordingly, the developing roller, the image holding member, the carrier and the like are easily contaminated with the polyethylene wax, which may cause deterioration in reliability of the developing agent.

Under the circumstances, as a production method of a toner having a shape and a surface composition that are purposefully controlled, an emulsion polymerization and aggregation method is proposed in JP-A-60-225170, JP-A-63-282749 and JP-A-6-282099.

In the emulsion polymerization and aggregation method, a resin dispersion liquid is once produced by emulsion polymerization, and a colorant dispersion liquid containing a colorant dispersed in a solvent is separately produced. The dispersion liquids are mixed to form aggregated particles having a diameter corresponding to the particle diameter of the target toner, and the aggregated particles are fused by heating to provide toner particles. According to the emulsion polymerization and aggregation method, the shape of the toner particles can be arbitrarily controlled from an irregular shape to a spherical shape by selecting a heat temperature condition.

In the emulsion polymerization and aggregation method, toner particles can be obtained by aggregating and fusing at least a dispersion liquid of resin fine particles and a dispersion liquid of a colorant in a predetermined condition. However, the emulsion polymerization and aggregation method involves limitation in kind of a resin that can be used, i.e., a styrene-acrylic copolymer is suitable for the method, but a polyester resin, which is known as a resin excellent in fixing property, cannot be applied to the method.

As a production method of a toner using a polyester resin, a phase inversion emulsification method is known, in which a colorant dispersion liquid and the like are added a solution of a binder resin dissolved in an organic solvent, and water is added to the mixture, but in this method, it is necessary to remove and recover the organic solvent. JP-A-9-311502 proposes a method that can produce fine particles in an aqueous medium by mechanical agitation without the use of an organic solvent, but in this method, it is necessary to feed a resin or the like in a molten state to an agitating device, which brings about difficulty in handling. Furthermore, this method is low in degree of freedom upon controlling the shape, and thus the shape of the toner cannot be arbitrarily controlled from an irregular shape to a spherical shape.

JP-A-2007-323071 proposes a method that solves the aforementioned problems, in which materials constituting a toner are melt-kneaded or mixed, and the mixture in a molten state under heating is mechanically formed into fine particles, which are then aggregated to produce a toner. This method can provide a developing agent that has a small particle diameter, a controlled shape, less fluctuation in surface composition, and favorable fixing property and image quality, without the use of an organic solvent.

However, when a batch type high-speed agitation device is used as a device for forming fine particles in this method, the polyester resin is formed into fine particles under a high temperature and high alkaline state, whereby the polyester resin may be hydrolyzed to deteriorate the fixing property while depending on the kind of the polyester resin.

The use of a high-pressure device for forming fine particles is advantageous since the polyester resin can be processed continuously and can be suppressed from being hydrolyzed by shortening the period of time when the polyester resin is under a high temperature and high alkaline state. However, the particles may be grown to coarse particles upon cooling and may stay in a pipe of the high-pressure device for forming fine particles.

SUMMARY

An object of the invention is to provide a toner, in which fine particles constituting the toner formed under high pressure are suppressed from being grown to coarse particles upon cooling, and favorable fixing property and image quality are provided.

The invention relates to, as one aspect, a method for producing a developing agent containing:

mixing a granular mixture containing a binder resin and a colorant, an aqueous medium and an alkaline pH controlling agent to prepare a toner material dispersion liquid;

subjecting the toner material dispersion liquid to mechanical shearing under a temperature of a glass transition point Tg of the binder resin or more and a pressure of 10 MPa or more to make the granular mixture into fine particles, thereby providing a dispersion liquid containing fine particles having a smaller particle diameter than a particle diameter of the granular mixture;

depressurizing the dispersion liquid containing the fine particles with two or more stages while maintaining the temperature of a glass transition point Tg of the binder resin or more; and cooling the depressurized fine particle dispersion liquid to a temperature of a glass transition point Tg of the binder resin or less.

The invention also relates to, as another aspect, a developing agent that is produced by a method containing: mixing a granular mixture containing a binder resin and a colorant, an aqueous medium and an alkaline pH controlling agent to prepare a toner material dispersion liquid; subjecting the toner material dispersion liquid to mechanical shearing under a temperature of a glass transition point Tg of the binder resin or more and a pressure of 10 MPa or more to make the granular mixture into fine particles, thereby providing a dispersion liquid containing fine particles having a smaller particle diameter than a particle diameter of the granular mixture; depressurizing the dispersion liquid containing the fine particles with two or more stages while maintaining the temperature of a glass transition point Tg of the binder resin or more; and cooling the depressurized fine particle dispersion liquid to a temperature of a glass transition point Tg of the binder resin or less.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

According to an embodiment of the invention, the method for producing a developing agent contains: mixing a granular mixture containing a binder resin and a colorant, an aqueous medium and an alkaline pH controlling agent to prepare a toner material dispersion liquid; and subjecting the toner material dispersion liquid to mechanical shearing to make the granular mixture into fine particles, thereby providing a dispersion liquid containing fine particles having a smaller particle diameter than a particle diameter of the granular mixture. The toner material dispersion liquid is subjected to mechanical shearing under a temperature of a glass transition point Tg of the binder resin or more and a pressure of 10 MPa or more, and the resulting dispersion liquid containing the fine particles is depressurized with two or more stages while maintaining the temperature of a glass transition point Tg of the binder resin or more and then cooled to a temperature of a glass transition point Tg of the binder resin or less.

According to another embodiment of the invention, the developing agent is obtained by the aforementioned method.

In the embodiment of the invention, the toner material dispersion liquid is subjected to mechanical shearing under a high pressure to prevent the binder resin from being thermally decomposed during formation of fine particles, thereby providing a developing agent excellent in fixing property. In the embodiment of the invention, the toner material dispersion liquid is improved in self-dispersibility by the addition of the alkaline pH controlling agent. Accordingly, during the process, in which the toner material dispersion liquid is introduced to a nozzle of a high-pressure fine particle forming machine for subjecting the dispersion liquid to mechanical shearing under high pressure in the nozzle, and then discharged from the nozzle, the toner material dispersion liquid is prevented from clogging the valve and from forming coarse particles. As a result, a developing agent which has high production stability and high image quality can be provided.

The embodiment of the invention is described in detail with reference to the drawings.

Figure 1:
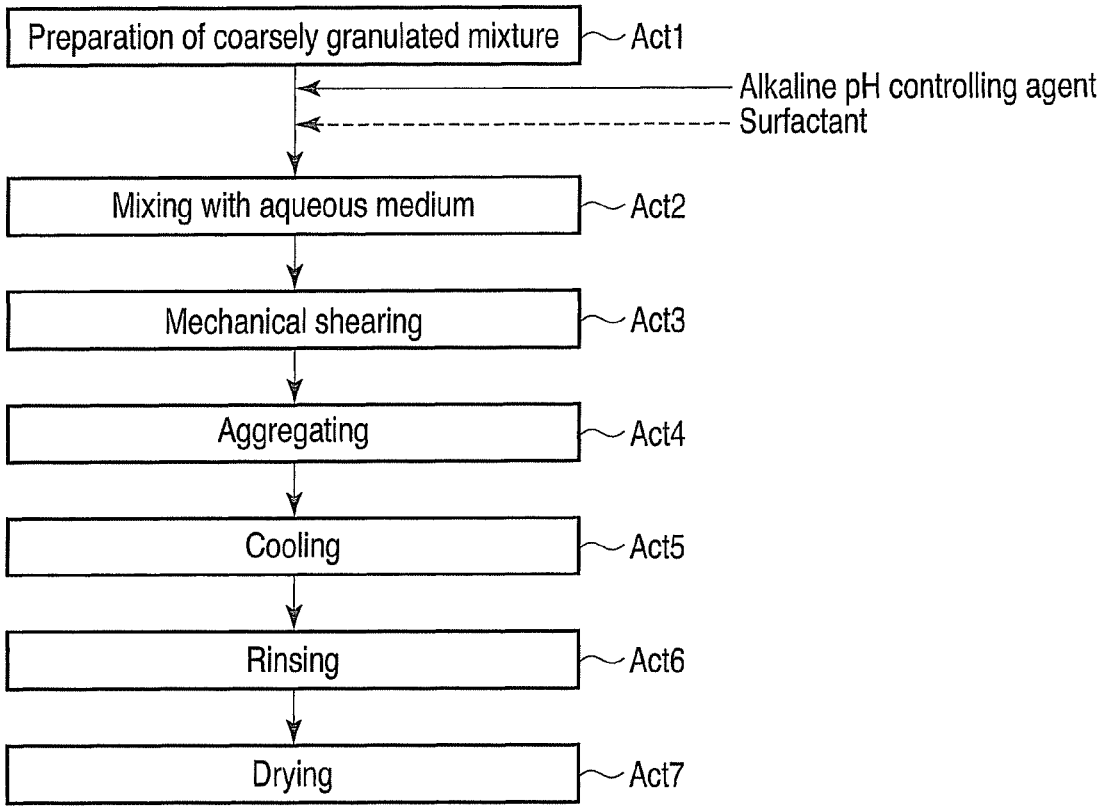
FIG. 1 is a flow chart showing an example of the method for producing a developing agent according to the invention.

FIG. 1 is a flow chart showing an example of the method for producing a developing agent according to the invention.

In the method for producing a developing agent of the invention, a coarsely granulated mixture containing a binder resin and a colorant is prepared (Act 1).

The coarsely granulated mixture can be obtained, for example, by melt-kneading a mixture containing a binder resin and a colorant, and then coarsely pulverizing the mixture, or in alternative, can be obtained, for example, by granulating the mixture containing a binder resin and a colorant.

The coarsely granulated mixture preferably has a volume average particle diameter of from 0.01 to 2 mm.

A volume average particle diameter of less than 0.01 mm requires strong agitation for dispersing in an aqueous medium to provide such tendency that bubbles formed by agitation deteriorate the dispersed state of the mixture, and a volume average particle diameter exceeding 2 mm is too large as compared to a gap provided in the shearing unit, thereby providing such tendencies that the particles clog the shearing unit, and particles having heterogeneous composition or particle diameter are formed due to difference in energy applied to the inner part and the outer part of the particles.

The coarsely granulated mixture more preferably has a volume average particle diameter of from 0.02 to 1 mm.

The coarsely granulated mixture is then dispersed in an aqueous medium to form a dispersion liquid of the coarsely granulated mixture (Act 2).

Upon forming the dispersion liquid of the coarsely granulated mixture, at least an alkaline pH controlling agent is added to an aqueous medium, and a surfactant may be arbitrarily added to the same.

The addition of the alkaline pH controlling agent increases the dissociation degree of the dissociative functional group on the surface of the mixture and the polarity thereof are increased, thereby enhancing the self-dispersibility of the mixture. In particular, clogging, which is a major defect of the high-pressure fine particle forming machine, can be suppressed.

The addition of a surfactant facilitates dispersion of the mixture to the aqueous medium through the function of the surfactant adsorbed on the surface of the mixture.

After forming the dispersion liquid, the dispersion liquid may be subjected to wet pulverization depending on necessity. The wet pulverization decreases the particle diameter, which may stabilize the subsequent process.

Subsequently, the resulting dispersion liquid is subjected to mechanical shearing, thereby making the coarsely granulated mixture into fine particles (Act 3).

In the embodiment of the invention, a high-pressure fine particle forming machine may be used for a device for subjecting the dispersion liquid to mechanical shearing (mechanical shearing device). In the high-pressure fine particle forming machine, a material is subjected to a shearing force by passing through a minute nozzle under a pressure of from 10 to 300 MPa with a high-pressure pump to form fine particles of the material.

The high-pressure pump is generally a plunger type pump, and the number of plungers may be 1 to 10 depending on the production scale. The number of plungers is preferably 2 or more for suppressing a pulsating flow as much as possible. For preventing a check valve of the high-pressure pump from being clogged, a pump for sending the dispersion liquid to be processed to the upstream side of the check valve is preferably used. The pump is not particularly limited in type as far as it can send a liquid, and a diaphragm pump or the like may be used.

The mechanical shearing device used in the invention has a nozzle having a diameter, for example, of from 0.05 to 0.5 mm. Examples of the shape of the nozzle include a through nozzle and a collision nozzle. The diameter of the nozzle may be changed stepwise. When the diameter of the nozzle is changed stepwise, plural nozzles having different diameters may be arranged in parallel or in series.

Figure 2:
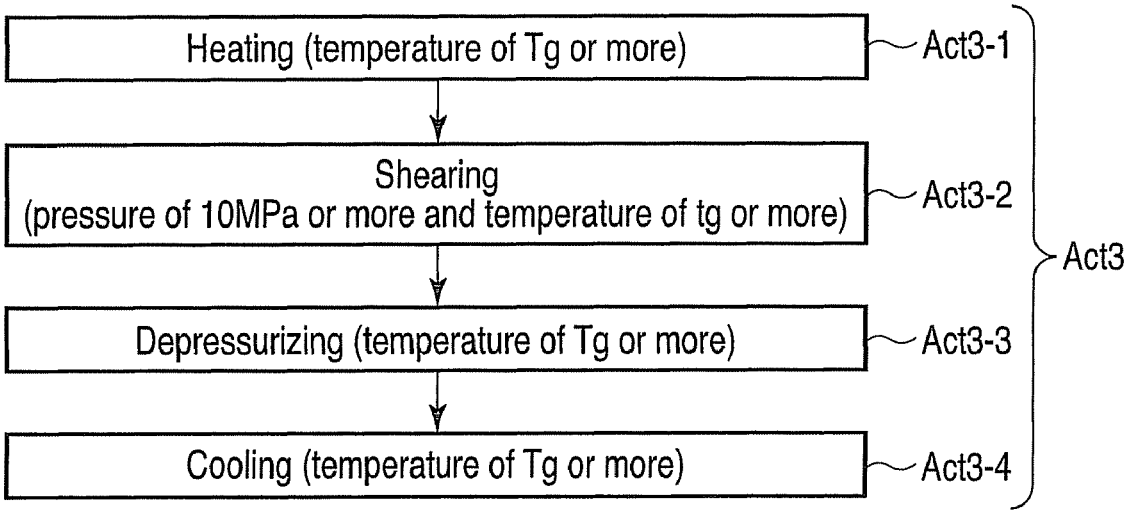
FIG. 2 is a flow chart showing details of mechanical shearing (Act 3) in FIG. 1.
Figure 3:
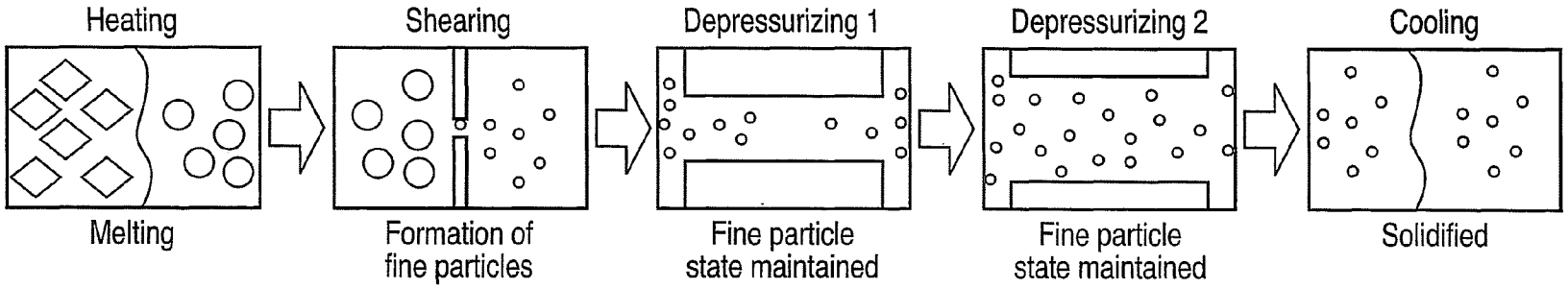
FIG. 3 is a schematic chart showing operations in FIG. 2.

FIG. 2 is a flow chart showing details of the mechanical shearing (Act 3) in FIG. 1, and FIG. 3 is a schematic chart showing the operations in FIG. 2.

The dispersion liquid is heated to a temperature of the glass transition point Tg of the binder resin or more (Act 3-1). In FIG. 3, the rhombus and the circle schematically show a solid state and a molten state, respectively. The dispersion liquid is heated since the binder resin is melted as shown in FIG. 3. The dispersion liquid is heated on either the upstream side or the downstream side of the plunger of the high-pressure pump with respect to the direction, in which the dispersion liquid flows, but is heated necessarily on the upstream side of the nozzle unit. When the heating unit is provided on the upstream side of the plunger, the dispersion liquid is placed, for example, in a hopper or the like capable of heating the dispersion liquid, and the heated dispersion liquid is sent continuously to the high-pressure pump. When the heating unit is provided on the downstream side of the plunger, a pipe for a heat exchanger may be provided between the check valve on the outlet of the high-pressure pump and the nozzle, and the dispersion liquid is heated with a heating device, such as an oil bath. In this case, the device is easily handled since the dispersion liquid is introduced into a part at an ordinary temperature, and therefore, the dispersion liquid can be processed continuously even when the heating temperature is 100° C. or more. Furthermore, the binder resin can be suppressed from being hydrolyzed since the period of time when the binder resin is under a high temperature can be shortened.

The heating temperature varies depending on the melting characteristics of the binder resin, i.e., a lower temperature may be employed for a resin that can be easily melted, and a higher temperature is necessary for a resin that is difficultly melted. When the dispersion liquid is passed continuously through the heat exchanger, the heating temperature may be changed by the flow rate of the dispersion liquid and the length of the pipe for the heat exchanger. When the flow rate is large, or the pipe is short, a higher temperature is required, and when the flow rate is small, or the pipe is long, the dispersion liquid is sufficiently heated, and thus can be processed at a lower temperature. The heating temperature may be from 100 to 200° C. when the flow rate is from 300 to 400 cc/min, the pipe for the heat exchanger is ⅜-inch high-pressure pipe having a length of 12 m, the binder resin has Tg of 60° C., and the toner has a softening point Tm of 130° C. The softening point of the toner may be measured by a temperature increasing method with Flow Tester CFT-500, produced by Shimadzu Corporation, and the point on the curve corresponding to a descent amount of the plunger of 2 mm on the chart is designated as the softening point.

The dispersion liquid thus heated is then subjected to shearing under application of a pressure of 10 MPa or more (Act 3-2). The shearing force is applied with the nozzle. Upon passing through the nozzle under application of a high pressure of 10 MPa or more, the molten toner component is formed into fine particles. The pressure may be from 10 to 300 MPa. A pressure of less than 10 MPa may fail to make fine particles, and a pressure exceeding 300 MPa may accelerate wear of sealing members and the like of the high-pressure fine particle forming machine.

The dispersion liquid is then depressurized with two or more stages, for example, with two stages, while maintaining the temperature of Tg or more (Act 3-3 and Act 3-4). After passing the nozzle, the dispersion liquid is gradually returned to the atmospheric pressure, but not opened immediately to the atmospheric pressure. The pressure after passing the depressurizing unit may be from 0.1 to 10 MPa, and preferably from 0.1 to 5 MPa. A pressure exceeding 10 MPa may aggregate the fine particles to form coarse particles.

The depressurizing unit may be constituted by at least one of a cell or a two-way valve having a flow path that is larger than the diameter of the nozzle of the fine particle forming unit and is smaller than the diameter of the connecting pipe. This constitution can prevent aggregation and integration from occurring as much as possible. The depressurizing unit is preferably constituted by plural cells or valves having different diameters. Fine particles having a sharp particle size distribution with less coarse particles can be obtained by depressurizing the dispersion liquid with plural stages.

The dispersion liquid is finally cooled to a temperature of Tg or less (Act 3-5). The molten fine particles is solidified by cooling. The cooling unit, in which the dispersion liquid to be processed is passed, is preferably a pipe for a heat exchanger having cold water runs therein continuously, by which the dispersion liquid is quickly cooled to prevent aggregation and integration due to cooling from occurring.

Fine particles having a diameter of 2 μm or less can be obtained through the process of from Act 3-1 to Act 3-4.

The fine particles are then aggregated to form aggregated particles (Act 4). The process of Act 4 is intended to aggregate the resulting fine particles to grow the particles to a particle diameter that is necessary for a toner. The aggregated particles are obtained by breaking the stable state of the fine particles by adding an aggregating agent, heating or the like.

Figure 4:
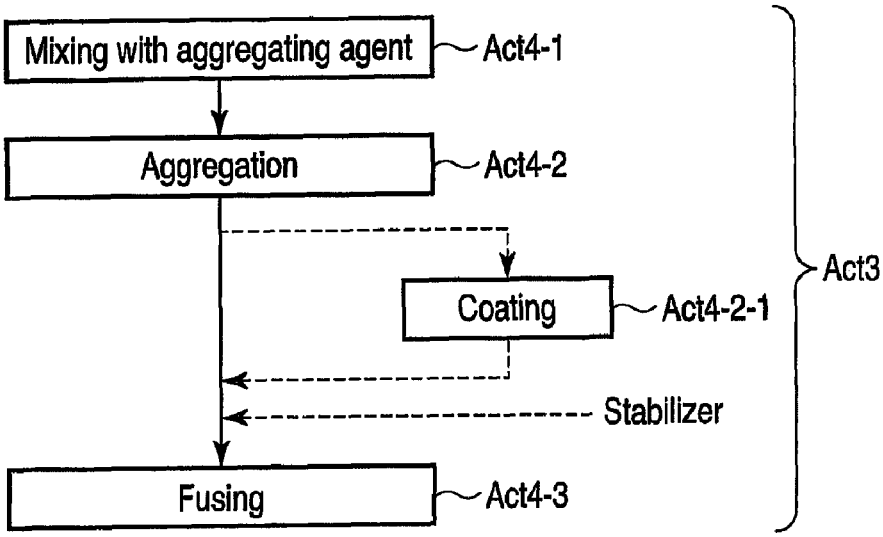
FIG. 4 is a flow chart showing details of aggregation (Act 4) in FIG. 1.

FIG. 4 is a flow chart showing details of aggregation in FIG. 1.

An aggregating agent is added to the fine particle dispersion liquid (Act 4-1). The amount of the aggregating agent added may vary depending on the dispersion stability of the fine particles, and may be large for high dispersion stability or small for low dispersion stability. The amount of the aggregating agent may also vary depending on the kind of the aggregating agent. Aluminum sulfate may be added as the aggregating agent in an amount of from 0.1 to 50% by weight, and preferably from 0.5 to 10% by weight. After adding the aggregating agent having strong aggregating property, such as aluminum sulfate, a particle diameter of from 0.1 to 10 μm is obtained. The addition of an aggregating agent having weak aggregating property, such as sodium chloride, may fail to cause aggregation. Upon adding the aggregating agent, a rotor stator type dispersing device is preferably used for preventing the fine particles from being rapidly aggregated. A pH controlling agent or a surfactant may also be added for preventing the fine particles from being rapidly aggregated, before adding the aggregating agent. According to the procedure, a toner finally obtained has a homogeneous particle diameter.

The fine particles are then aggregated by heating (Act 4-2). Aggregated particles having a particle diameter of about from 2 to 10 μm are produced by heating.

The aggregated particles are then fused by heating (Act 4-3). A stabilizer, such as a pH controlling agent and a surfactant, is added to the aggregated particles to stabilize the aggregated particles, which are then heated to a temperature of Tg of the binder resin or more, thereby fusing the surface of the aggregated particles. After fusing, an target particle diameter of from 2 to 10 μm is obtained.

The processes of aggregation and fusing may occur simultaneously depending on the kind and the solid concentration of the fine particles, and the kind of the aggregating agent.

The particle diameter and the particle size distribution are largely influenced by the agitation conditions upon aggregating and fusing. An agitation speed that provides a suitable shearing force is preferred. Too weak the shearing force may provide a large particle diameter with coarse particles. Too strong the shearing force may provide a small particle diameter with fine powder. A reacting vessel is preferably equipped with a baffle. The baffle suppresses bubbles from being entrained, makes the agitation state in the vessel homogeneous, and reinforcing the shearing force. The particle diameter and the particle size distribution are also largely influenced by the temperature increasing rate, the addition speed of the additive, and the like, in addition to the agitation conditions.

The surface of the aggregated particles may be coated with a coating resin having a smaller particle diameter than the aggregated particles, for example, 2 μm or less, depending on necessity.

As a first method for coating the coating resin, coating resin fine particles and the like are added to the aggregated particle dispersion liquid and attached to the surface of the aggregated particles by such a manner as addition of an aggregating agent and control of pH, and then the coating resin particles and the like are fused to the surface of the aggregated particles (Act 4-2-1).

As a second method, a polymerizable monomer is added to the aggregated particle-containing solution, thereby enclosing or swelling the surface of the aggregated particles with the monomer, and then the monomer is polymerized.

As a third method, after fusing the aggregated particles, the resulting particles are rinsed and dried, and the resin fine particles and the like are mechanically attached to the surface of the fused particles with a hybridizer or the like.

Among these, the first method is a simple method that can provide a toner having a high coating ratio. The resin fine particles to be coated in this method can be obtained with a high-pressure fine particle forming machine. The high-pressure fine particle forming machine preferably has the aforementioned structures and functions.

For example, a granular mixture containing the coating resin, an aqueous medium and an alkaline pH controlling agent are mixed to prepare a coating resin material dispersion liquid, to which a shearing force is applied under a temperature of Tg of the binder resin or more and a pressure of 10 MPa or more, and the dispersion liquid is then depressurized with two or more stages while maintaining the temperature of Tg or more, followed by cooling to a temperature of Tg or less, thereby providing coating resin fine particles having a particle diameter, for example, of 2 μm or less.

The particle diameter of the coating resin fine particles may be from 0.01 to 0.5 μm. A particle diameter of less than 0.01 μm may require too large an amount of the aggregating agent, and a particle diameter exceeding 0.5 μm may provide a toner having a larger particle diameter.

The coating resin contains at least a resin that is of the same kind as the binder resin.

The coating resin may further contain a colorant, a charge controlling agent and the like, in addition to the binder resin.

The colorant and the releasing agent on the surface of the toner can be encompassed by coating the coating resin, whereby the stability of images is improved upon continuous printing.

After forming the fused aggregated particles, the dispersion liquid thereof is cooled, for example, to 5° C. or the glass transition point or less (Act 5), then rinsed, for example, with a filter press (Act 6), and dried (Act 7) to provide toner particles.

A known production apparatus may be used in the invention, and examples thereof are described below.

The high-pressure fine particle forming machine is not particularly limited as far as it can be equipped with the constitution according to the invention and can form fine particles in a wet state, and examples thereof include Nanomizer (produced by Yoshida Kikai Co., Ltd.), Altimizer (produced by Sugino Machine, Ltd.), NANO3000 (produced by Beryu Co., Ltd.), Microfluidizer (produced by Mizuho Industrial Co., Ltd.) and Homogenizer (produced by Izumi Food Machinery Co., Ltd.).

The kneading device is not particularly limited as far as it can melt-knead materials, and examples thereof include a single screw extruder, a twin screw extruder, a pressure kneader, a Banbury mixer and a Brabender mixer. Specific examples thereof include FCM (produced by Kobe Steel, Ltd.), NCM (produced by Kobe Steel, Ltd.), LCM (produced by Kobe Steel, Ltd.), ACM (produced by Kobe Steel, Ltd.), KTX (produced by Kobe Steel, Ltd.), GT (produced by Ikegai Corporation), PCM (produced by Ikegai Corporation), TEX (produced by Japan Steel Works, Ltd.), TEM (produced by Toshiba Machine Co., Ltd.), ZSK (produced by Warner Pfleiderer Corporation) and Kneadex (produced by Mitsui Mining Co., Ltd.).

The dry pulverizer is not particularly limited as far as it can pulverize materials in a dry state, and examples thereof include a ball mill, an atomizer, a Bantam mill, a pulverizer, a hammer mill, a roll crusher, a cutter mill and a jet mill.

The dispersing device, the mixing device and the wet pulverizing device are not particularly limited as far as they can disperse, mix and pulverize materials in a wet state, and examples thereof include a rotor stator agitating device and a media agitating device. Examples of the rotor stator agitating device include Ultra-Turrax (produced by IKA Works Japan Co., Ltd.), T.K. Auto Homo Mixer (produced by Primix Corporation), T.K. Pipeline Homo Mixer (produced by Primix Corporation), T.K. Filmics (produced by Primix Corporation), Cleamix (produced by M-Technique Co., Ltd.), Clear SS5 (produced by M-Technique Co., Ltd.), Cavitron (produced by Eurotec, Ltd.) and Fine Flow Mill (produced by Pacific Machinery & Engineering Co., Ltd.). Examples of the media agitating device include Viscomill (produced by Aimex Co., Ltd.), Apexmill (produced by Kotobuki Industries Co., Ltd.), Star Mill (produced by Ashizawa Finetech, Ltd.), DCP Superflow (produced by Nippon Eirich Co., Ltd.), MP Mill (produced by Inoue Manufacturing Co., Ltd.), Spike Mill (produced by Inoue Manufacturing Co., Ltd.), Mighty Mill (produced by Inoue Manufacturing Co., Ltd.) and SC Mill (produced by Mitsui Mining Co., Ltd.).

Preferred examples of the rinsing device include a centrifugal separator and a filter press. Examples of the rinsing liquid include water, ion exchanged water, purified water, water adjusted to have acidity and water adjusted to have alkalinity.

Preferred examples of the drying device include a vacuum dryer, an air flow dryer and a fluidized dryer.

Examples of the dry mixer include Henschel Mixer (produced by Mitsui Mining Co., Ltd.), Super Mixer (produced by Kawata MFG Co., Ltd.), Ribocorn (produced by Okawara Corporation), Nauta Mixer (produced by Hosokawa Micron Co., Ltd.), Tervurizer (produced by Hosokawa Micron Co., Ltd.), Cyclomix (produced by Hosokawa Micron Co., Ltd.), Spiralpin Mixer (produced by Pacific Machinery & Engineering Co., Ltd.) and Lodige Mixer (produced by Matsubo Corporation).

As the materials for a toner used in the invention, known materials for a toner may be used, examples of which include a polymerizable monomer, a chain transfer agent, a crosslinking agent, a polymerization initiator, a surfactant, an aggregating agent, a pH controlling agent, a resin, a colorant and a releasing agent.

Examples of the vinyl polymerizable monomer include an aromatic vinyl monomer, such as styrene, methylstyrene, methoxystyrene, phenylstyrene and chlorostyrene, an ester monomer, such as methyl acrylate, ethyl acrylate, butyl acrylate, methyl methacrylate, ethyl methacrylate and butyl methacrylate, a carboxylic acid-containing monomer, such as acrylic acid, methacrylic acid, fumaric acid and maleic acid, an amine monomer, such as aminoacrylate, acrylamide, methacrylamide, vinylpyridine and vinylpyrrolidone, and derivatives thereof, which may be used solely or as a mixture of two or more of them. As for the condensation polymerizable monomer include, examples of the alcohol component include an aliphatic diol, such as ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,4-butenediol, 1,2-propanediol, 1,3-butanediol, neopentyl glycol and 2-butyl-2-ethyl-1,3-propanediol, an aromatic diol of an alkylene oxide adduct of bisphenol A, such as polyoxypropylene(2.2)-2,2-bis(4-hydroxyphenyl) propane and polyoxyethylene(2.2)-2,2-bis(4-hydroxyphenyl)propane, an aromatic diol, a trihydric or higher polyhydric alcohol, such as glycerin and pentaerythritol, and derivatives thereof, which may be used solely or as a mixture of two or more of them, and examples of the carboxylic acid component include an aliphatic dicarboxylic acid, such as oxalic acid, malonic acid, maleic acid, fumaric acid, citraconic acid, itaconic acid, glutaric acid, succinic acid, adipic acid, sebacic acid, azelaic acid, n-dodecylsuccinic acid and n-dodecenylsuccinic acid, an alicyclic dicarboxylic acid, such as cyclohexanedicarboxylic acid, an aromatic dicarboxylic acid, such as phthalic acid, isophthalic acid and terephthalic acid, a tribasic or higher polycarboxylic acid, such as trimellitic acid and pyromellitic acid, and derivatives thereof, which may be used solely or as a mixture of two or more of them.

Examples of the chain transfer agent include carbon tetrabromide, dodecylmercaptan, trichlorobromomethane and dodecanethiol.

Examples of the crosslinking agent include a compound having two or more unsaturated bonds, such as divinylbenzene, divinyl ether, divinylnaphthalene and diethylene glycol methacrylate.

The polymerization initiator is appropriately selected depending on the polymerization method, and includes a water soluble initiator and an oil soluble initiator. Examples of the water soluble initiator include a persulfate salt, such as potassium persulfate and ammonium persulfate, an azo compound, such as 2,2-azobis(2-aminopropane), hydrogen peroxide, and benzoyl peroxide. Examples of the oil soluble initiator include an azo compound, such as azobisisobutyronitrile and azobisdimethylvaleronitrile, and a peroxide compound, such as benzoyl peroxide and dichlorobenzoil peroxide. A redox initiator may be used depending on necessity.

The surfactant includes an anionic surfactant, a cationic surfactant, an amphoteric surfactant and nonionic surfactant. Examples of the anionic surfactant include an fatty acid salt, an alkyl sulfate ester salt, a polyoxyethylene alkyl ether sulfate ester salt, an alkylbenzenesulfonate salt, an alkylnapthalenesulfonate salt, a dialkylsulfosuccinate salt, an alkyl diphenyl ether disulfonate salt, a polyoxyehtylene alkyl ether phosphate salt, an alkenylsuccinate salt, an alkanesuccinate salt, a napthalenesulfonic acid formalin condensate, an aromatic sulfonic acid formalin condensate, a polycarboxylic acid and a polycarboxylate salt. Examples of the cationic surfactant include an alkylamine salt and an alkyl quaternary ammonium salt. Examples of the amphoteric surfactant include an alkyl betaine and an alkylamine oxide. Examples of the nonionic surfactant include a polyoxyethylene alkyl ether, a polyoxyalkylene alkyl ether, a polyoxyethylene derivative, a sorbitan fatty acid ester, polyoxyethylene sorbitan fatty acid ester, a polyoxyethylene sorbitol fatty acid ester, a glycerin fatty acid ester, a polyoxyethylene fatty acid ester, a polyoxyethylene hardened caster oil, a polyoxyethylene alkylamine and an alkylalkanolamide. These compounds may be used solely or as a mixture of two or more of them.

Examples of the aggregating agent include a monovalent salt, such as sodium chloride, potassium chloride, lithium chloride and sodium sulfate, a divalent salt, such as magnesium chloride, calcium chloride, magnesium sulfate, calcium nitrate, zinc chloride, ferric chloride and ferric sulfate, and a trivalent salt, such as aluminum sulfate and aluminum chloride, and also include a quaternary ammonium salt, such as polyhydroxypropyldimethylammonium chloride and polydiallyldimethylammonium chloride, an organic coagulating agent and an organic polymer aggregating agent.

Examples of the pH controlling agent include an acid, such as hydrochloric acid, sulfuric acid, nitric acid, acetic acid, citric acid and phosphoric acid, and an alkali, such as sodium hydroxide, potassium hydroxide, ammonia and an amine compound. Examples of the amine compound include dimethylamine, trimethylamine, monoethylamine, diethylamine, triethylamine, propylamine, isopropylamine, dipropylamine, butylamine, isobutylamine, sec-butylamine, monoethanolamine, diethanolamine, triethanolamine, triisopropanolamine, isopropanolamine, dimethylethanolamine, diethylethanolamine, N-butyldiethanolamine, N,N-dimethyl-1,3-diaminopropane and N,N-diethyl-1,3-diaminopropane. A surfactant that exhibits acidity or alkalinity may also be used as the pH controlling agent.

Examples of the binder resin include a styrene resin, such as polystyrene, a styrene-butadiene copolymer and a styrene-acrylic copolymer, an ethylene resin, such as polyethylene, an ethylene-vinyl acetate copolymer, an ethylene-norbornene copolymer and an ethylene-vinyl alcohol copolymer, a polyester resin, an acrylic resin, a phenol resin, an epoxy resin, an allyl phthalate resin, a polyamide resin and a maleic acid resin. These resins may be used solely or in combination of two or more of them. The binder resin may be produced through polymerization by using the polymerizable monomer, the chain transfer agent, the crosslinking agent, the polymerization initiator and the like described above. The resin preferably has a glass transition temperature of from 40 to 80° C. and a softening point of from 80 to 180° C. A polyester resin is particularly preferred owing to the favorable fixing property thereof. The polyester resin preferably has an acid value of 1 or more. The use of the polyester resin having an acid value facilitates the effect of the alkaline pH controlling agent upon forming fine particles, whereby fine particles having a small particle diameter are provided, and clogging, which is a major defect of the high-pressure fine particle forming machine, can be suppressed.

Examples of the colorant include carbon black, and organic and inorganic pigments and dyes. Examples of the carbon black include acetylene black, furnace black, thermal black, channel black and Ketjen black. Examples of the yellow pigment include C.I. Pigment Yellow 1, 2, 3, 4, 5, 6, 7, 10, 11, 12, 13, 14, 15, 16, 17, 23, 65, 73, 74, 81, 83, 93, 95, 97, 98, 109, 117, 120, 137, 138, 139, 147, 151, 154, 167, 173, 180, 181, 183 and 185, C.I. Vat Yellow 1, 3 and 20, which may be used solely or as a mixture of two or more of them. Examples of the magenta pigment include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209 and 238, C.I. Pigment Violet 19, and C.I. Vat Red 1, 2, 10, 13, 15, 23, 29 and 35, which may be used solely or as a mixture of two or more of them. Examples of the cyan pigment include C.I. Pigment Blue 2, 3, 15, 16 and 17, C.I. Vat Blue 6, and C.I. Acid Blue 45, which may be used solely or as a mixture of two or more of them.

Examples of the releasing agent include aliphatic hydrocarbon wax, such as low molecular weight polyethylene, low molecular weight polypropylene, a polyolefin copolymer, polyolefin wax, microcrystalline wax, paraffin wax and Fischer-Tropsch wax, an oxide of aliphatic hydrocarbon wax, such as oxidized polyethylene wax, and a block copolymer thereof, vegetable wax, such as candelilla wax, carnauba wax, haze wax, jojoba wax and rice wax, animal wax, such as bees wax, lanolin and whale wax, mineral wax, such as ozokerite, ceresin and petrolatum, and wax containing an aliphatic acid ester as a major component, such as montanate ester wax and caster wax, and a wholly or partially deacidified fatty acid ester, such as deacidified carnauba wax, and also include a saturated linear fatty acid, such as palmitic acid, stearic acid, montanic acid and an alkylcarboxylic acid having a higher alkyl group, an unsaturated fatty acid, such as brassidic acid, eleostearic acid and parinaric acid, a saturated alcohol, such as stearil alcohol, eicosyl alcohol, behenyl alcohol, carnaubyl alcohol, ceryl alcohol, melissyl alcohol and a higher alkyl alcohol having a higher alkyl group, a polyhydric alcohol, such as sorbitol, a fatty acid amide, such as linoleic amide, oleic amide and lauric amid, a saturated fatty acid bisamide, such as methylene bisstearic amide, ethylene biscapric amide, ethylene bislauric amide and hexamethylene bisstearic amide, an unsaturated fatty acid amide, such as ethylene bisoleic amide, hexamethylene bisoleic amide, N,N'-dioleyladipic amide and N,N'-dioleylsebacic amide, an aromatic bisamide, such as m-xylenebisstearic amide and N,N'-distearylisophthalic amide, a fatty acid metallic salt (which is ordinarily referred to as a metallic soap), such as calcium stearate, calcium laurate, zinc stearate and magnesium stearate, wax obtained by grafting a vinyl monomer, such as styrene and acrylic acid, to aliphatic hydrocarbon wax, a partially esterified product of a fatty acid and a polyhydric alcohol, such as behenic acid monoglyceride, and a methyl ester compound having a hydroxyl group obtained by hydrogenating a vegetable oil.

A charge controlling agent, an additive to the surface of the toner particles, and the like may be added depending on necessity.

Examples of the charge controlling agent include a metal-containing azo compound, which may be a complex, a complex salt or a mixture thereof containing a metallic element, such as iron, cobalt and chromium, and also include a metal-containing salicylic acid derivative, which may be a complex, a complex salt or a mixture thereof containing a metallic element, such as zirconium, zinc, chromium and boron.

Inorganic fine particles may be added as an additive to the surface of the toner particles in an amount of from 0.01 to 20% by weight based on the total amount of the toner for controlling the fluidity and the charging property of the toner particles. Examples of the inorganic fine particles include silica, titania, alumina, strontium titanate and tin oxide, which may be used solely or as a mixture of two or more of them. The surface of the inorganic fine particles is preferably treated with a hydrophobic agent from the standpoint of enhancement of environmental safety. In addition to the inorganic oxide particles, resin fine particles having a diameter of 1 μm or less may be externally added for enhancing the cleaning property.

The invention is described more specifically with reference to examples below.

The molecular weight of the binder resin was measured by a GPC method (polystyrene conversion), and the glass transition point Tg of the binder resin was measured with a DSC method.

Production of Mixture Coarse Particles A

| | |
|---|---|
| Polyester resin (Mw: 26,000, Tg: 61° C., Tm: 120° C., acid value (AV): 15) | 90 parts by weight |
| Pigment Blue 15:3 (produced by Clariant Japan Co., Ltd.) | 5 parts by weight |
| Rice wax | 5 parts by weight |

The aforementioned components were mixed and then melt-kneaded with a twin screw kneader set at a temperature of 120° C. to provide a kneaded product.

The kneaded product was coarsely pulverized with a Bantam mill, produced by Hosokawa Micron Co., Ltd., to a volume average particle diameter of 0.1 mm or less to produce coarse particles.

Production of Mixture Coarse Particles B

| | |
|---|---|
| Polyester resin (Mw: 15,000, Tg: 59° C., Tm: 110° C., AV: 10) | 90 parts by weight |
| Pigment Blue 15:3 (produced by Clariant Japan Co., Ltd.) | 5 parts by weight |
| Rice wax | 5 parts by weight |

The aforementioned components were mixed and then melt-kneaded with a twin screw kneader set at a temperature of 120° C. to provide a kneaded product.

The kneaded product was coarsely pulverized with a Bantam mill, produced by Hosokawa Micron Co., Ltd., to a volume average particle diameter of 0.1 mm or less to produce coarse particles.

Production of Mixture Coarse Particles C

| | |
|---|---|
| Styrene-acrylic resin (Mw: 24,000, Tg: 59° C., Tm: 110° C., AV: 0) | 90 parts by weight |
| Pigment Blue 15:3 (produced by Clariant Japan Co., Ltd.) | 5 parts by weight |
| Rice wax | 5 parts by weight |

The aforementioned components were mixed and then melt-kneaded with a twin screw kneader set at a temperature of 120° C. to provide a kneaded product.

The kneaded product was coarsely pulverized with a Bantam mill, produced by Hosokawa Micron Co., Ltd., to a volume average particle diameter of 0.1 mm or less to produce coarse particles.

Production of Coarse Particles for Coating

A polyester resin (Mw: 26,000, Tg: 61° C., Tm: 120° C., AV: 15) was pulverized with a Bantam mill, produced by Hosokawa Micron Co., Ltd., to a volume average particle diameter of 0.1 mm or less to produce coarse particles.

Example 1

30 parts by weight of the mixture coarse particles A, 3 parts by weight of sodium dodecylbenzenesulfonate as a surfactant, 2 parts by weight of dimethylaminoethanol as an alkaline pH controlling agent, and 65 parts by weight of ion exchanged water were mixed to prepare a dispersion liquid.

The coarse particle A dispersion liquid was processed to fine particles at 180° C. and 150 MPa, depressurized while maintaining 180° C., and then cooled to 30° C., thereby providing a fine particle dispersion liquid, by using NANO3000. NANO3000 used was equipped with a high-pressure pipe for a heat exchanger having a length of 12 m immersed in an oil bath as a heating unit, a high-pressure pipe having nozzles of 0.13 μm and 0.28 μm in serial as a pressurizing unit, a medium-pressure pipe having cells having pores of 0.4 μm, 1.0 μm, 0.75 μm and 1.5 μm and 1.0 μm in series as a depressurizing unit, and a pipe for a heat exchanger having a length of 12 m that was capable of being cooled with tap water as a cooling unit. The particles thus obtained had a particle diameter of 0.52 μm as measured with SALD7000, produced by Shimadzu Corporation.

Figure 5:
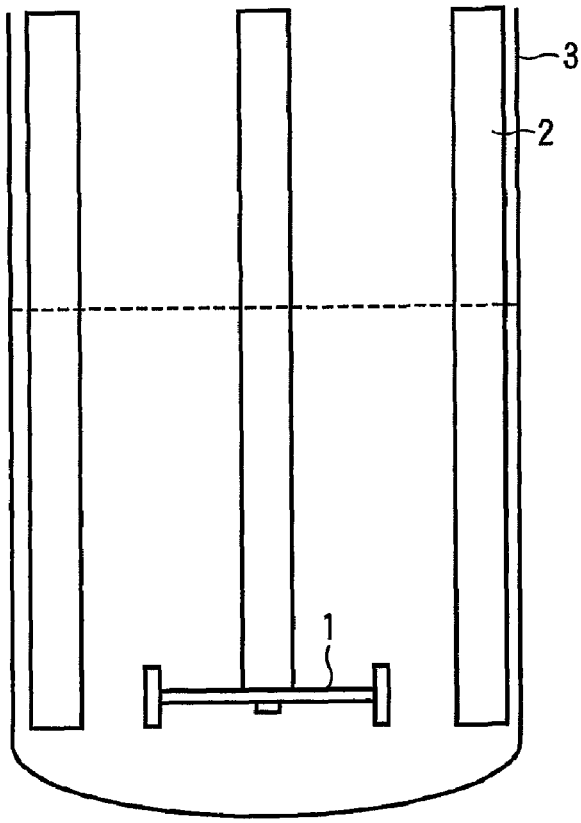
FIG. 5 is a schematic cross sectional view showing an example of an aggregation reacting vessel that can be used in the method for producing a developing agent according to the invention.

35 parts by weight of the resulting fine particle dispersion liquid and 65 parts by weight of ion exchanged water were mixed, to which 10 parts by weight of a 5% aluminum sulfate aqueous solution as an aggregating agent was added under agitating at 6,500 rpm with a homogenizer (T25), produced by IKA Works Japan Co., Ltd., and the dispersion liquid thus produced was placed in an aggregation reaction vessel shown in FIG. 5.

Figure 6:
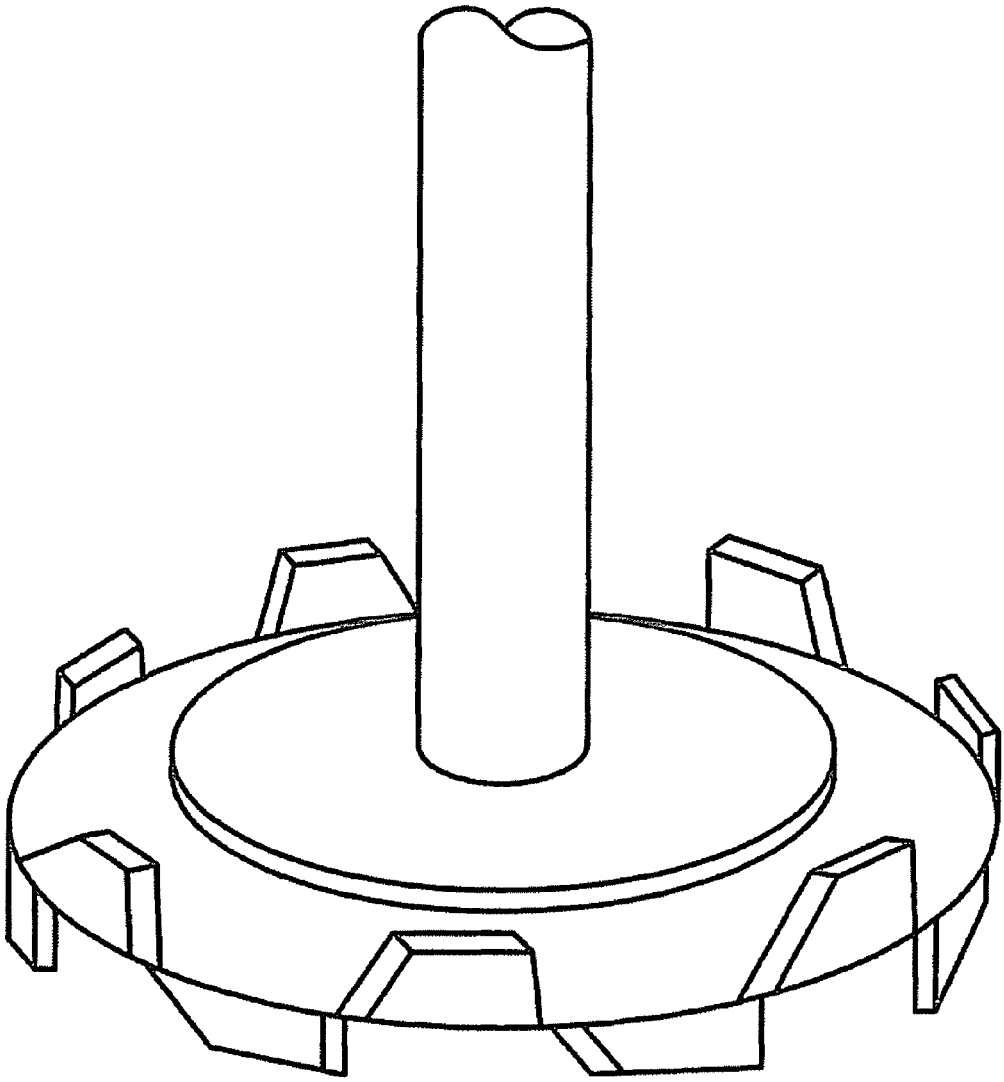
FIG. 6 is a perspective view showing an edged turbine blade used in the aggregation reacting vessel shown in FIG. 5.

As shown in FIG. 5, the aggregation reaction vessel 3 had an edged turbine blade 1 and four plate baffles 3 installed therein. The dispersion liquid was heated in the reaction vessel 3 to 60° C. under agitating at 700 rpm. FIG. 6 is a perspective view showing the edged turbine blade.

Thereafter, 20 parts by weight of a 10% sodium polycarboxylate aqueous solution as a stabilizer was added to the dispersion liquid, which was heated to 95° C., thereby providing fused aggregated particles.

The fused aggregated particles were measured for particle diameter with Multisizer 3, produced by Beckman Coulter, Inc., and had a 50% volume average particle diameter Dv of 5.1 μm and a 50% number average particle diameter Dp of 4.5 μm, which indicated a sharp particle size distribution.

The solid content of the resulting dispersion liquid was rinsed by repeatedly filtering and rinsing with ion exchanged water until the electroconductivity of the filtrate reached 50 μS/cm. Thereafter, the solid content was dried with a vacuum dryer until the water content reached 1.0% by weight or less to provide dried particles.

After drying, 2 parts by weight of hydrophobic silica and 0.5 part by weight of titanium oxide as additives were attached to the surface of the toner particles to provide a target electrophotographic toner.

The resulting electrophotographic toner was installed in a multifunction peripheral, e-STUDIO 218c, produced by Toshiba Tec Corporation, which was modified for evaluation, and the toner was evaluated for image quality and fixing property, and thus exhibited good results therefor.

Example 2

30 parts by weight of the mixture coarse particles A, 3 parts by weight of sodium dodecylbenzenesulfonate as a surfactant, 0.5 part by weight of sodium hydroxide as an alkaline pH controlling agent, and 66.5 parts by weight of ion exchanged water were mixed to prepare a dispersion liquid.

The coarse particle A dispersion liquid was processed to fine particles at 180° C. and 150 MPa, depressurized while maintaining 180° C., and then cooled to 30° C., thereby providing a fine particle dispersion liquid, by using NANO3000 having the same configuration as in Example 1.

The particles thus obtained had a particle diameter of 0.34 μm as measured with SALD7000, produced by Shimadzu Corporation.

35 parts by weight of the resulting fine particle dispersion liquid and 65 parts by weight of ion exchanged water were mixed, to which 10 parts by weight of a 5% aluminum sulfate aqueous solution as an aggregating agent was added under agitating at 6,500 rpm with a homogenizer (T25), produced by IKA Works Japan Co., Ltd., and the dispersion liquid thus produced was heated in the same aggregation reaction vessel as in Example 1 to 60° C. under agitating at 700 rpm. Thereafter, 20 parts by weight of a 10% sodium polycarboxylate aqueous solution as a stabilizer was added to the dispersion liquid, which was heated to 95° C., thereby providing fused aggregated particles. The fused aggregated particles were measured for particle diameter with Multisizer 3, produced by Beckman Coulter, Inc., and had a 50% volume average particle diameter Dv of 4.8 μm and a 50% number average particle diameter Dp of 4.3 μm, which indicated a sharp particle size distribution.

The solid content of the resulting dispersion liquid was rinsed by repeatedly filtering and rinsing with ion exchanged water until the electroconductivity of the filtrate reached 50 μS/cm. Thereafter, the solid content was dried with a vacuum dryer until the water content reached 1.0% by weight or less to provide dried particles.

After drying, 2 parts by weight of hydrophobic silica and 0.5 part by weight of titanium oxide as additives were attached to the surface of the toner particles to provide a target electrophotographic toner.

The resulting electrophotographic toner was installed in a multifunction peripheral, e-STUDIO 218c, produced by Toshiba Tec Corporation, which was modified for evaluation, and the toner was evaluated for image quality and fixing property, and thus exhibited good results therefor.

Example 3

30 parts by weight of the mixture coarse particles A, 3 parts by weight of sodium dodecylbenzenesulfonate as a surfactant, 2 parts by weight of dimethylaminoethanol as an alkaline pH controlling agent, and 65 parts by weight of ion exchanged water were mixed to prepare a dispersion liquid.

The coarse particle A dispersion liquid was processed to fine particles at 150° C. and 100 MPa, depressurized while maintaining 150° C., and then cooled to 30° C., thereby providing a fine particle dispersion liquid, by using NANO3000 having the same configuration as in Example 1. The particles thus obtained had a particle diameter of 0.82 μm as measured with SALD7000, produced by Shimadzu Corporation.

35 parts by weight of the resulting fine particle dispersion liquid and 65 parts by weight of ion exchanged water were mixed, to which 10 parts by weight of a 5% aluminum sulfate aqueous solution as an aggregating agent was added under agitating at 6,500 rpm with a homogenizer (T25), produced by IKA Works Japan Co., Ltd., and the dispersion liquid thus produced was heated in the same aggregation reaction vessel as in Example 1 to 60° C. under agitating at 700 rpm. Thereafter, 20 parts by weight of a 10% sodium polycarboxylate aqueous solution as a stabilizer was added to the dispersion liquid, which was heated to 95° C., thereby providing fused aggregated particles. The fused aggregated particles were measured for particle diameter with Multisizer 3, produced by Beckman Coulter, Inc., and had a 50% volume average particle diameter Dv of 5.8 μm and a 50% number average particle diameter Dp of 5.2 μm, which indicated a sharp particle size distribution.

The solid content of the resulting dispersion liquid was rinsed by repeatedly filtering and rinsing with ion exchanged water until the electroconductivity of the filtrate reached 50 μS/cm. Thereafter, the solid content was dried with a vacuum dryer until the water content reached 1.0% by weight or less to provide dried particles.

After drying, 2 parts by weight of hydrophobic silica and 0.5 part by weight of titanium oxide as additives were attached to the surface of the toner particles to provide a target electrophotographic toner.

The resulting electrophotographic toner was installed in a multifunction peripheral, e-STUDIO 218c, produced by Toshiba Tec Corporation, which was modified for evaluation, and the toner was evaluated for image quality and fixing property, and thus exhibited good results therefor.

Example 4

30 parts by weight of the mixture coarse particles B, 3 parts by weight of sodium dodecylbenzenesulfonate as a surfactant, 1.5 parts by weight of dimethylaminoethanol as an alkaline pH controlling agent, and 65.5 parts by weight of ion exchanged water were mixed to prepare a dispersion liquid.

The coarse particle B dispersion liquid was processed to fine particles at 180° C. and 150 MPa, depressurized while maintaining 180° C., and then cooled to 30° C., thereby providing a fine particle dispersion liquid, by using NANO3000 having the same configuration as in Example 1. The particles thus obtained had a particle diameter of 0.67 μm as measured with SALD7000, produced by Shimadzu Corporation.

35 parts by weight of the resulting fine particle dispersion liquid and 65 parts by weight of ion exchanged water were mixed, to which 10 parts by weight of a 5% aluminum sulfate aqueous solution as an aggregating agent was added under agitating at 6,500 rpm with a homogenizer (T25), produced by IKA Works Japan Co., Ltd., and the dispersion liquid thus produced was heated in the same aggregation reaction vessel as in Example 1 to 60° C. under agitating at 700 rpm. Thereafter, 20 parts by weight of a 10% sodium polycarboxylate aqueous solution as a stabilizer was added to the dispersion liquid, which was heated to 95° C., thereby providing fused aggregated particles. The fused aggregated particles were measured for particle diameter with Multisizer 3, produced by Beckman Coulter, Inc., and had a 50% volume average particle diameter Dv of 5.3 μm and a 50% number average particle diameter Dp of 4.8 μm, which indicated a sharp particle size distribution.

The solid content of the resulting dispersion liquid was rinsed by repeatedly filtering and rinsing with ion exchanged water until the electroconductivity of the filtrate reached 50 μS/cm. Thereafter, the solid content was dried with a vacuum dryer until the water content reached 1.0% by weight or less to provide dried particles.

After drying, 2 parts by weight of hydrophobic silica and 0.5 part by weight of titanium oxide as additives were attached to the surface of the toner particles to provide a target electrophotographic toner.

The resulting electrophotographic toner was installed in a multifunction peripheral, e-STUDIO 218c, produced by Toshiba Tec Corporation, which was modified for evaluation, and the toner was evaluated for image quality and fixing property, and thus exhibited good results therefor.

Example 5

35 parts by weight of the fine particle dispersion liquid obtained in Example 1 and 65 parts by weight of ion exchanged water were mixed, to which 10 parts by weight of a 5% aluminum sulfate aqueous solution as an aggregating agent was added under agitating at 6,500 rpm with a homogenizer (T25), produced by IKA Works Japan Co., Ltd., and the dispersion liquid thus produced was heated in the same aggregation reaction vessel as in Example 1 to 60° C. under agitating at 700 rpm. Thereafter, 5 parts by weight of a 10% dimethylaminoethanol aqueous solution as a stabilizer was added to the dispersion liquid, which was heated to 95° C., thereby providing fused aggregated particles. The fused aggregated particles were measured for particle diameter with Multisizer 3, produced by Beckman Coulter, Inc., and had a 50% volume average particle diameter Dv of 5.8 μm and a 50% number average particle diameter Dp of 5.2 μm, which indicated a sharp particle size distribution.

The solid content of the resulting dispersion liquid was rinsed by repeatedly filtering and rinsing with ion exchanged water until the electroconductivity of the filtrate reached 50 μS/cm. Thereafter, the solid content was dried with a vacuum dryer until the water content reached 1.0% by weight or less to provide dried particles.

After drying, 2 parts by weight of hydrophobic silica and 0.5 part by weight of titanium oxide as additives were attached to the surface of the toner particles to provide a target electrophotographic toner.

The resulting electrophotographic toner was installed in a multifunction peripheral, e-STUDIO 218c, produced by Toshiba Tec Corporation, which was modified for evaluation, and the toner was evaluated for image quality and fixing property, and thus exhibited good results therefor.

Example 6

30 parts by weight of coarse particles for coating, 3 parts by weight of sodium dodecylbenzenesulfonate as a surfactant, 2 parts by weight of dimethylaminoethanol as an alkaline pH controlling agent, and 65 parts by weight of ion exchanged water were mixed to prepare a dispersion liquid for coating.

The dispersion liquid for coating was processed to fine particles at 180° C. and 150 MPa, depressurized while maintaining 180° C., and then cooled to 30° C., thereby providing a fine particle dispersion liquid for coating, by using NANO3000. NANO3000 used was equipped with a high-pressure pipe for a heat exchanger having a length of 12 m immersed in an oil bath as a heating unit, a high-pressure pipe having nozzles of 0.13 μm and 0.28 μm in serial as a pressurizing unit, a medium-pressure pipe having cells having pores of 0.4 μm, 1.0 μm, 0.75 μm and 1.5 μm and 1.0 μm in series as a depressurizing unit, and a pipe for a heat exchanger having a length of 12 m that was capable of being cooled with tap water as a cooling unit. The particles thus obtained had a particle diameter of 0.2 μm as measured with SALD7000, produced by Shimadzu Corporation.

35 parts by weight of the fine particle dispersion liquid obtained in Example 1 and 65 parts by weight of ion exchanged water were mixed, to which 10 parts by weight of a 5% aluminum sulfate aqueous solution as an aggregating agent was added under agitating at 6,500 rpm with a homogenizer (T25), produced by IKA Works Japan Co., Ltd., and the dispersion liquid thus produced was heated in the same aggregation reaction vessel as in Example 1 to 50° C. under agitating at 700 rpm. Thereafter, 7 parts by weight of the fine particle dispersion for coating was gradually added thereto, and 2 parts by weight of a 5% aluminum sulfate aqueous solution as an aggregating agent was gradually added, thereby coating the fine particles for coating on the aggregated particles. Thereafter, 20 parts by weight of a 10% sodium polycarboxylate aqueous solution as a stabilizer was added to the dispersion liquid, which was heated to 95° C., thereby providing coated fused aggregated particles. The coated fused aggregated particles were measured for particle diameter with Multisizer 3, produced by Beckman Coulter, Inc., and had a 50% volume average particle diameter Dv of 5.9 μm and a 50% number average particle diameter Dp of 5.3 μm, which indicated a sharp particle size distribution.

The solid content of the resulting dispersion liquid was rinsed by repeatedly filtering and rinsing with ion exchanged water until the electroconductivity of the filtrate reached 50 μS/cm. Thereafter, the solid content was dried with a vacuum dryer until the water content reached 1.0% by weight or less to provide dried particles.

After drying, 2 parts by weight of hydrophobic silica and 0.5 part by weight of titanium oxide as additives were attached to the surface of the toner particles to provide a target electrophotographic toner.

The resulting electrophotographic toner was installed in a multifunction peripheral, e-STUDIO 218c, produced by Toshiba Tec Corporation, which was modified for evaluation, and the toner was evaluated for image quality and fixing property, and thus exhibited good results therefor.

Comparative Example 1

30 parts by weight of the mixture coarse particles A, 3 parts by weight of sodium dodecylbenzenesulfonate as a surfactant, 2 parts by weight of dimethylaminoethanol as an alkaline pH controlling agent, and 65 parts by weight of ion exchanged water were mixed to prepare a dispersion liquid.

The coarse particle A dispersion liquid was processed to fine particles at 180° C. and 150 MPa, cooled to 30° C., and then depressurized at 30° C., thereby providing a fine particle dispersion liquid, by using NANO3000. NANO3000 used was equipped with a high-pressure pipe for a heat exchanger having a length of 12 m immersed in an oil bath as a heating unit, a high-pressure pipe having nozzles of 0.13 μm and 0.28 μm in serial as a pressurizing unit, a pipe for a heat exchanger having a length of 12 m that was capable of being cooled with tap water as a cooling unit, and a medium-pressure pipe having cells having pores of 0.4 μm, 1.0 μm, 0.75 μm and 1.5 μm and 1.0 μm in series as a depressurizing unit. The particles thus obtained had a particle diameter of 2.3 μm as measured with SALD7000, produced by Shimadzu Corporation. 35 parts by weight of the resulting fine particle dispersion liquid and 65 parts by weight of ion exchanged water were mixed, to which 10 parts by weight of a 5% aluminum sulfate aqueous solution as an aggregating agent was added under agitating at 6,500 rpm with a homogenizer (T25), produced by IKA Works Japan Co., Ltd., and the dispersion liquid thus produced was heated in the same aggregation reaction vessel as in Example 1 to 60° C. under agitating at 700 rpm. Thereafter, 20 parts by weight of a 10% sodium polycarboxylate aqueous solution as a stabilizer was added to the dispersion liquid, which was heated to 95° C., thereby providing fused aggregated particles. The fused aggregated particles were measured for particle diameter with Multisizer 3, produced by Beckman Coulter, Inc., and had a 50% volume average particle diameter Dv of 7.5 μm and a 50% number average particle diameter Dp of 3.2 μm, which indicated a broad particle size distribution.

The solid content of the resulting dispersion liquid was rinsed by repeatedly filtering and rinsing with ion exchanged water until the electroconductivity of the filtrate reached 50 μS/cm. Thereafter, the solid content was dried with a vacuum dryer until the water content reached 1.0% by weight or less to provide dried particles.

After drying, 2 parts by weight of hydrophobic silica and 0.5 part by weight of titanium oxide as additives were attached to the surface of the toner particles to provide a target electrophotographic toner.

The resulting electrophotographic toner was installed in a multifunction peripheral, e-STUDIO 218c, produced by Toshiba Tec Corporation, which was modified for evaluation, and the toner was evaluated for image quality and fixing property. As a result, deteriorated image quality was obtained due to the influence of coarse particles although no problem occurred in fixing property.

Comparative Example 2

30 parts by weight of the mixture coarse particles A, 3 parts by weight of sodium dodecylbenzenesulfonate as a surfactant, 2 parts by weight of dimethylaminoethanol as an alkaline pH controlling agent, and 65 parts by weight of ion exchanged water were mixed to prepare a dispersion liquid.

The coarse particle A dispersion liquid was processed to fine particles at 50° C. and 150 MPa, depressurized while maintaining 50° C., and then cooled to 30° C., thereby providing a fine particle dispersion liquid A1, by using NANO3000. NANO3000 having the same configuration as in Example 1. The particles thus obtained had a particle diameter of 54 μm as measured with SALD7000, produced by Shimadzu Corporation.

The particles were not evaluated since they had too large a particle diameter for a toner after processing to fine particles.

Comparative Example 3

30 parts by weight of the mixture coarse particles A, 3 parts by weight of sodium dodecylbenzenesulfonate as a surfactant, and 67 parts by weight of ion exchanged water were mixed to prepare a dispersion liquid.

The coarse particle A dispersion liquid was processed to fine particles at 180° C. and 150 MPa by using NANO3000 having the same configuration as that in Example 1, depressurized while maintaining 180° C., and then cooled to 30° C., but the coarse particles were not able to be formed into fine particles due to clogging occurring in the piping of the cooling unit.

Comparative Example 4

30 parts by weight of the mixture coarse particles C, 3 parts by weight of sodium dodecylbenzenesulfonate as a surfactant, 2 parts by weight of dimethylaminoethanol as an alkaline pH controlling agent, and 65 parts by weight of ion exchanged water were mixed to prepare a dispersion liquid.

The coarse particle C dispersion liquid was processed to fine particles at 180° C. and 150 MPa, by using NANO3000 having the same configuration as that in Example 1, depressurized while maintaining 180° C., and then cooled to 30° C., but the coarse particles were not able to be formed into fine particles due to clogging occurring in the piping of the cooling unit.

Comparative Example 5

30 parts by weight of the mixture coarse particles A, 3 parts by weight of sodium dodecylbenzenesulfonate as a surfactant, 2 parts by weight of trimethylamine as an alkaline pH controlling agent, and 65 parts by weight of ion exchanged water were mixed to prepare a dispersion liquid.

The resulting dispersion liquid was placed in Cleamix as a batch high-speed agitating device, and the dispersion liquid was heated to 120° C. and then processed with Cleamix set at a rotation number of 6,000 for 30 minutes. After completing the process for forming fine particles, the dispersion liquid was cooled to ordinary temperature. The particles thus obtained had a particle diameter of 0.55 μm as measured with SALD7000, produced by Shimadzu Corporation.

35 parts by weight of the resulting fine particle dispersion liquid and 65 parts by weight of ion exchanged water were mixed, to which 10 parts by weight of a 5% aluminum sulfate aqueous solution as an aggregating agent was added under agitating at 6,500 rpm with a homogenizer (T25), produced by IKA Works Japan Co., Ltd., and the dispersion liquid thus produced was heated in the same aggregation reaction vessel as in Example 1 to 60° C. under agitating at 700 rpm. Thereafter, 20 parts by weight of a 10% sodium polycarboxylate aqueous solution as a stabilizer was added to the dispersion liquid, which was heated to 95° C., thereby providing fused aggregated particles. The fused aggregated particles were measured for particle diameter with Multisizer 3, produced by Beckman Coulter, Inc., and had a 50% volume average particle diameter Dv of 5.3 μm and a 50% number average particle diameter Dp of 4.7 μm, which indicated a sharp particle size distribution.

The solid content of the resulting dispersion liquid was rinsed by repeatedly filtering and rinsing with ion exchanged water until the electroconductivity of the filtrate reached 50 μS/cm. Thereafter, the solid content was dried with a vacuum dryer until the water content reached 1.0% by weight or less to provide dried particles.

After drying, 2 parts by weight of hydrophobic silica and 0.5 part by weight of titanium oxide as additives were attached to the surface of the toner particles to provide a target electrophotographic toner.

The resulting electrophotographic toner was installed in a multifunction peripheral, e-STUDIO 218c, produced by Toshiba Tec Corporation, which was modified for evaluation, and the toner was evaluated for image quality and fixing property. As a result, the high temperature limit of the non-offset range was deteriorated by −5° C. as compared to Example 1 although no problem occurred in image quality.

The results obtained in Examples and Comparative Examples are shown in Table 1 below.

TABLE 1

| | Materials used | | Particle forming conditions | | | Aggregation conditions |
|---|---|---|---|---|---|---|
| | Mixture | Alkaline pH controlling agent | Pressure (MPa) | Temperature (° C.) | Configuration | Stabilizer |
| Example 1 | A | dimethylaminoethanol | 150 | 180 | depressurizing → cooling | sodium polycarboxylate |
| Example 2 | A | sodium hydroxide | 150 | 180 | depressurizing → cooling | sodium polycarboxylate |

TABLE 1-continued

| | | | | | | |
|---|---|---|---|---|---|---|
| Example 3 | A | dimethylaminoethanol | 100 | 150 | depressurizing → cooling | sodium poly-carboxylate |
| Example 4 | B | dimethylaminoethanol | 150 | 180 | depressurizing → cooling | sodium poly-carboxylate |
| Example 5 | A | dimethylaminoethanol | 150 | 180 | depressurizing → cooling | demethyl-aminoethanol |
| Example 6 | A | dimethylaminoethanol | 150 | 180 | depressurizing → cooling | sodium poly-carboxylate |
| Comparative Example 1 | A | dimethylaminoethanol | 150 | 180 | cooling → depressurizing | sodium poly-carboxylate |
| Comparative Example 2 | A | dimethylaminoethanol | 150 | 50 | depressurizing → cooling | — |
| Comparative Example 3 | A | none | 150 | 180 | depressurizing → cooling | — |
| Comparative Example 4 | C | dimethylaminoethanol | 150 | 180 | depressurizing → cooling | — |
| Comparative Example 5 | A | dimethylaminoethanol | sealed | 120 | batch high speed agitation machine | sodium poly-carboxylate |

| | Aggregation conditions Encapsulation | Volume average particle diameter (μm) After forming fine particles | After aggregation and fusing | Evaluation Image quality | Fixing property |
|---|---|---|---|---|---|
| Example 1 | none | 0.52 | 5.1 | good | good |
| Example 2 | none | 0.34 | 4.8 | good | good |
| Example 3 | none | 0.82 | 5.8 | good | good |
| Example 4 | none | 0.67 | 5.3 | good | good |
| Example 5 | none | 0.52 | 5.8 | good | good |
| Example 6 | yes | 0.52 | 5.9 | good | good |
| Comparative Example 1 | none | 2.3 | 7.5 | poor due to coarse particles | good |
| Comparative Example 2 | — | 54 | — | unable to evaluate | |
| Comparative Example 3 | — | pipe clogged | — | unable to evaluate | |
| Comparative Example 4 | — | pipe clogged | — | unable to evaluate | |
| Comparative Example 5 | none | 0.55 | 5.3 | good | poor by −5° C. on high temperature limit |

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for producing a developing agent comprising:

mixing a granular mixture containing a binder resin and a colorant, an aqueous medium and an alkaline pH controlling agent to prepare a toner material dispersion liquid;

subjecting the toner material dispersion liquid to mechanical shearing under a temperature of a glass transition point Tg of the binder resin or more and a pressure of 10 MPa or more to make the granular mixture into fine particles to provide a dispersion liquid containing fine particles having a smaller particle diameter than a particle diameter of the granular mixture;

depressurizing the dispersion liquid containing the fine particles with two or more stages while maintaining the temperature of a glass transition point Tg of the binder resin or more; and cooling the depressurized fine particle dispersion liquid to a temperature of a glass transition point Tg of the binder resin or less.

2. The method according to claim 1, wherein the mixture contains at least a binder resin and a colorant melt-kneaded.

3. The method according to claim 1, wherein the method further comprises aggregating the fine particles in the cooled fine particle dispersion liquid to form aggregated particles.

4. The method according to claim 3, wherein a stabilizer is added upon forming the aggregated particles.

5. The method according to claim 3, wherein resin fine particles for coating containing at least a binder resin for coating are added upon forming the aggregated particles, thereby coating a surface of the aggregated particles with the resin fine particles for coating.

6. The method according to claim 5, wherein the resin fine particles for coating are produced by a method comprising: mixing a granular mixture containing the binder resin for coating, an aqueous medium and an alkaline pH controlling agent to prepare a dispersion liquid of the binder resin for coating; subjecting the dispersion liquid of the binder resin for coating to mechanical shearing under a temperature of a glass transition point Tg of the binder resin for coating or more and a pressure of 10 MPa or more; depressurizing the dispersion liquid with two or more stages while maintaining the temperature of a glass transition point Tg of the binder resin for coating or more; and cooling the dispersion liquid to a temperature of a glass transition point Tg of the binder resin for coating or less.

7. The method according to claim 1, wherein the binder resin is polyester having an acid value of 1 or more.

* * * * *